US007467910B2

(12) United States Patent
Lecuyer et al.

(10) Patent No.: US 7,467,910 B2
(45) Date of Patent: Dec. 23, 2008

(54) PREFABRICATED STRUCTURE MADE OF REINFORCED CONCRETE WITH AN INTEGRATED REMOVABLE HANDLING SYSTEM

(75) Inventors: Maurice Lecuyer, Saint-Rémi (CA); Eric Dupont, Sainte-Martine (CA); Raymond Leblanc, Châteauguay (CA); Mario Robichaud, Saint-Rémi (CA); Jean-Françcois Lupien, Longueuil (CA); Robert Tallard, Orford (CA)

(73) Assignee: Lecuyer & Fils LTEE, Quebec (CA)

( * ) Notice: Subject to any disclaimer, the term of this patent is extended or adjusted under 35 U.S.C. 154(b) by 486 days.

(21) Appl. No.: 11/389,160

(22) Filed: Mar. 27, 2006

(65) Prior Publication Data

US 2007/0095007 A1 May 3, 2007

(30) Foreign Application Priority Data

Nov. 3, 2005 (CA) ..... 2525293

(51) Int. Cl.
*E01C 5/08* (2006.01)

(52) U.S. Cl. ..... 404/70; 404/25; 52/19

(58) Field of Classification Search ..... 404/70, 404/25; 52/19

See application file for complete search history.

(56) References Cited

U.S. PATENT DOCUMENTS 2,228,123 A 1/1941 McMurray
3,687,597 A * 8/1972 Lavergne, Jr. ..... 425/438
6,712,546 B1 * 3/2004 Radu et al. ..... 404/8

* cited by examiner

*Primary Examiner*—Raymond W Addie
(74) *Attorney, Agent, or Firm*—Nixon & Vanderhye P.C.

(57) ABSTRACT

A method for manufacturing, transporting and installing on a building site a prefabricated structure made of reinforced concrete for the replacement of a structure such as a manhole, access chamber, access vault, junction box or other, which is buried in the ground and is part of an underground network such as a sewer, aqueduct, gas, electrical distribution, telecommunications, cable television and the like. In this method, concrete is poured in factory against the external surfaces of an integrated removable handling system, which is used as top part of a mold for manufacturing the prefabricated structure. The handling system is fixed to the prefabricated structure in a removable manner. The handling system remains in place during the subsequent steps of unmoulding, transporting and installing the prefabricated structure to the building site. Finally, once the installation is completed, the handling system is removed from the structure.

12 Claims, 3 Drawing Sheets

1

PREFABRICATED STRUCTURE MADE OF REINFORCED CONCRETE WITH AN INTEGRATED REMOVABLE HANDLING SYSTEM

FIELD OF THE INVENTION

The present invention relates to replacement of structures such as manholes, access chambers, access vaults, junction box and others which are buried into the ground and are parts of different underground networks such as sewer, aqueduct, gas, electrical distribution, telecommunication or cable television networks.

More particularly, the invention relates to a method for manufacturing, transporting and installing on a building site a prefabricated structure made of reinforced concrete by using an integrated, removable handling system.

BACKGROUND OF THE INVENTION

Underground networks such as electrical distribution networks, telecommunications networks, cable television networks and the like, comprise structures which must sometimes be replaced. These structures that are buried in the ground can be manholes, access chambers, access vaults, junction box and others.

One of the reasons that forces to replace the existing structures is the premature deterioration of the material (concrete or bricks) used at the time of the original construction. Another reason that forces to replace the existing structures is to comply with new requirements established for reasons of maintenance, safety, ergonomy and/or addition of equipment.

In practice, putting a network out of order even for a temporary period of time is not acceptable because numerous residential and commercial subscribers (read "customers") would be deprived of essential services. Any interruption of this type would prove to be extremely expensive for the subscribers. Some of these customers are hospitals, buildings with offices or shops which cannot interrupt their activities.

Consequently, it is necessary to develop working methods that would allow the people in charge of the maintenance of the networks to carry out different modifications while keeping the networks functional during the work.

An existing method currently used on building sites consists of demolishing the existing structure and rebuilding a new structure while maintaining in service the existing underground network. As an example, mention can be made of Hydro-Quebec which maintains its electrical supply underground cables functional in their original positions during all steps of demolition and reconstruction.

By way of example of how such an existing method can be carried out, reference can be made to the case where the structure to be replaced is an access vault (junction box) in which are located electrical cables, telecommunications cables as well as television cables. The cables are usually uncovered inside the access vault. However, these cables between an access vault to another one extend within poly vinyl chloride (PVC) conduits which are generally embedded with concrete (such are also called concrete duct).

In such a case, the existing method comprises two main steps, the first one being the demolition of the existing access vault, the second one being the reconstruction of such a vault.

During the demolition step, the following sub-steps are carried out:

- excavating and removing the material that covers and/or surrounds the structure;

- installing inside the structure, a self-bearing wooden roof under the ceiling of the structure (this roof is used to protect the equipment inside the structure during the demolition);
- demolishing and removing the chimney of the structure;
- demolishing and removing the ceiling of the structure;
- installing a horizontal beam made of steel and/or of wood on the surface of the street directly on top of the structure in the same direction as the existing cables;
- installing nylon cords attached to the beam for supporting the cables;
- demolishing and removing the vertical walls and the floor of the structure; and
- demolishing and removing the concrete of the duct on a few meters on each side of the structure to give some flexibility to move the cables in a safe manner while the workers are still working.

During the reconstruction step, the following sub-steps are carried out:

- excavating the ground to fit the dimensions of the new structure;
- preparing the foundation of the new structure;
- assembling and levelling a framing for the floor;
- pouring concrete to form the floor;
- assembling a framing to form the vertical walls. During this sub-step, the contractor must girdle the existing cables. To do so, wood boards must be cut to form semi-circle openings which are then positioned on opposite sides of each existing cable. Also, bell shaped PVC components must be cut and placed on both sides of each cable. These bell shaped PVC components offer a soft surface for pulling the cables. This sub-step requires a great dexterity from the workers because they handle nails and hammers near electric cables under tension;
- installing PVC conduits around the existing cables, these conduits extending from the structure up to the still intact concrete duct, (conduits cut in half over their length are used to carry out this task);
- pouring concrete to form the vertical walls;
- preparing a framing for the concrete duct;
- pouring concrete to form the concrete duct;
- installing a framing to form a new roof into the new structure. To carry out this sub-step, the contractor must install beams resting on the floor of the structure to support the framing in which the concrete will be poured to form the new roof. These beams have to be installed through the existing electrical cables without touching or damaging them;
- pouring concrete to form the roof;
- assembling a framing for chimneys;
- pouring concrete to form the chimneys;
- letting the concrete harden;
- installing embankment material;
- assembling a framing for a sidewalk;
- pouring concrete to form the sidewalk and the asphalt for the paving; and
- restarting public services (sidewalk, circulation lane, etc).

As may be noticed, the existing method described hereinabove requires a long time intervention of the workers, which increases the risk of injuries, particularly when the workers are close to electrical cables under tension. Moreover, the total time needed to complete the work is very long. Indeed, the time required to carry out all the steps mentioned above is approximately four weeks.

Thus, there is a need for a faster and safer method for replacing underground structures.

SUMMARY OF THE INVENTION

The object of the present invention is to provide a method that satisfies the above-mentioned need.

More particularly, the present invention is directed to a method for manufacturing, transporting and installing on a building site a prefabricated structure made of reinforced concrete by using an integrated handling system that is removable after the installation is completed, the method comprising:

a. manufacturing in a mold the prefabricated structure made of reinforced concrete, by positioning in an upper part of the mold the above-mentioned handling system which comprises external surfaces and fixation means to fix the system in a removable way to the prefabricated structure, and by pouring concrete against the external surfaces of the handling system to form the prefabricated structure directly on it;

b. unmoulding the prefabricated structure from the mold by using the handling system;

c. installing the prefabricated structure at the building site by using again the handling system; and d. removing the handling system from the prefabricated structure by detaching its fixation means.

Preferably, the handling system comprises a top part and a bottom part that are connected to each other by removable fastening means. In such a case, the fixation means used to fix the handling system to the prefabricated structure may advantageously be located on the bottom part of the handling system.

Preferably also, the top part of the handling system defines an opening and the bottom part of the handling system comprises separable sides and removable corners.

Preferably again, the top part of the handling system comprises outside faces with inclined sides to facilitate unmoulding of the prefabricated structure. The top part of the handling system may also be provided with handles.

As aforesaid, the advantages of the invention are as follows:

no framing is necessary to rebuild the floor;

no framing necessary to rebuild the vertical walls;

a very limited presence of workers is required near the electrical cables under tension;

no vertical beam and no false roof framing is necessary to rebuild the roof;

no framing is necessary to rebuild the roof;

the prefabricated structure is made in a factory to replace a concrete structure poured on the spot, thereby allowing an immediate embankment (shortened time); and a safe integrated removable handling system is provided for the prefabricated structure made of reinforced concrete.

The invention and its advantages will be better understood upon reading the following non restrictive description of a preferred embodiment thereof made with reference to the accompanying drawings.

DETAILED DESCRIPTION OF A PREFERRED EMBODIMENT OF THE INVENTION

Figure 1:
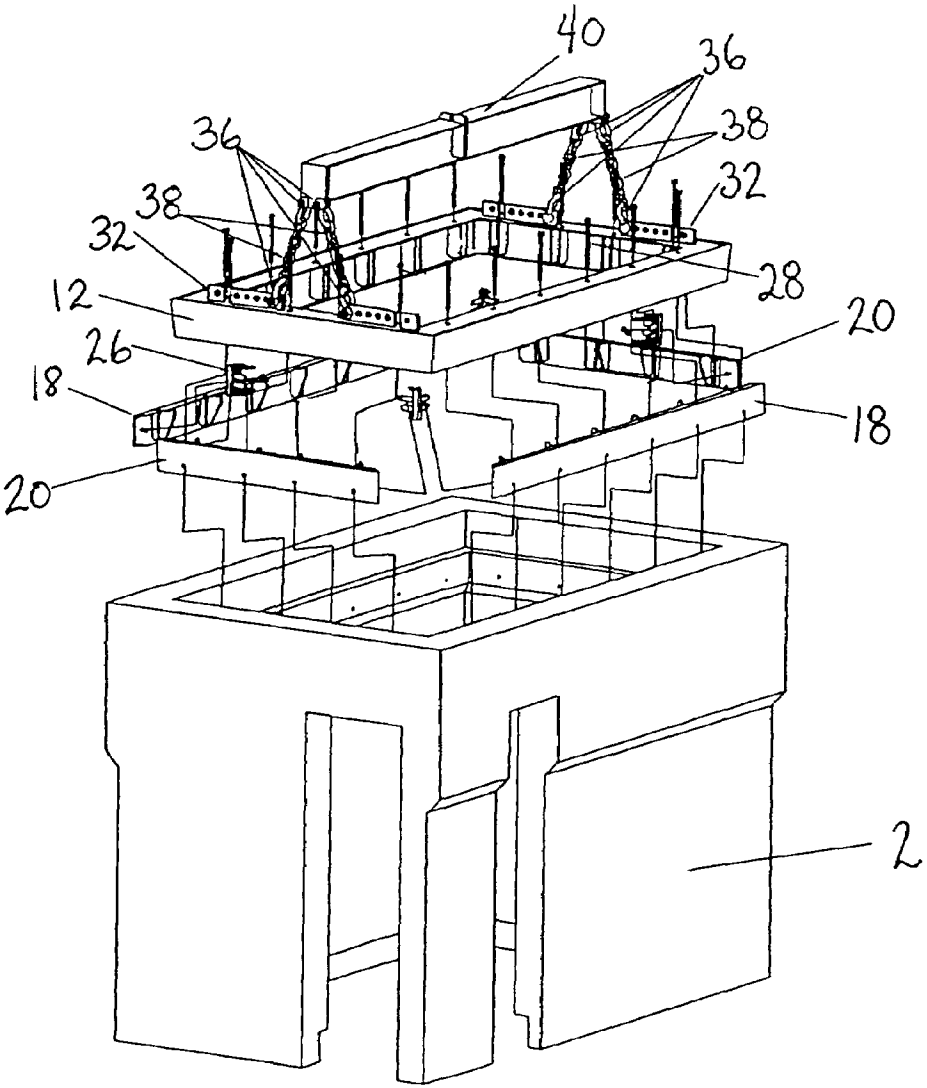
FIG. 1 is an exploded perspective view of a prefabricated structure made of reinforced concrete with an integrated removable handling system according to a preferred embodiment of the invention.
Figure 2:
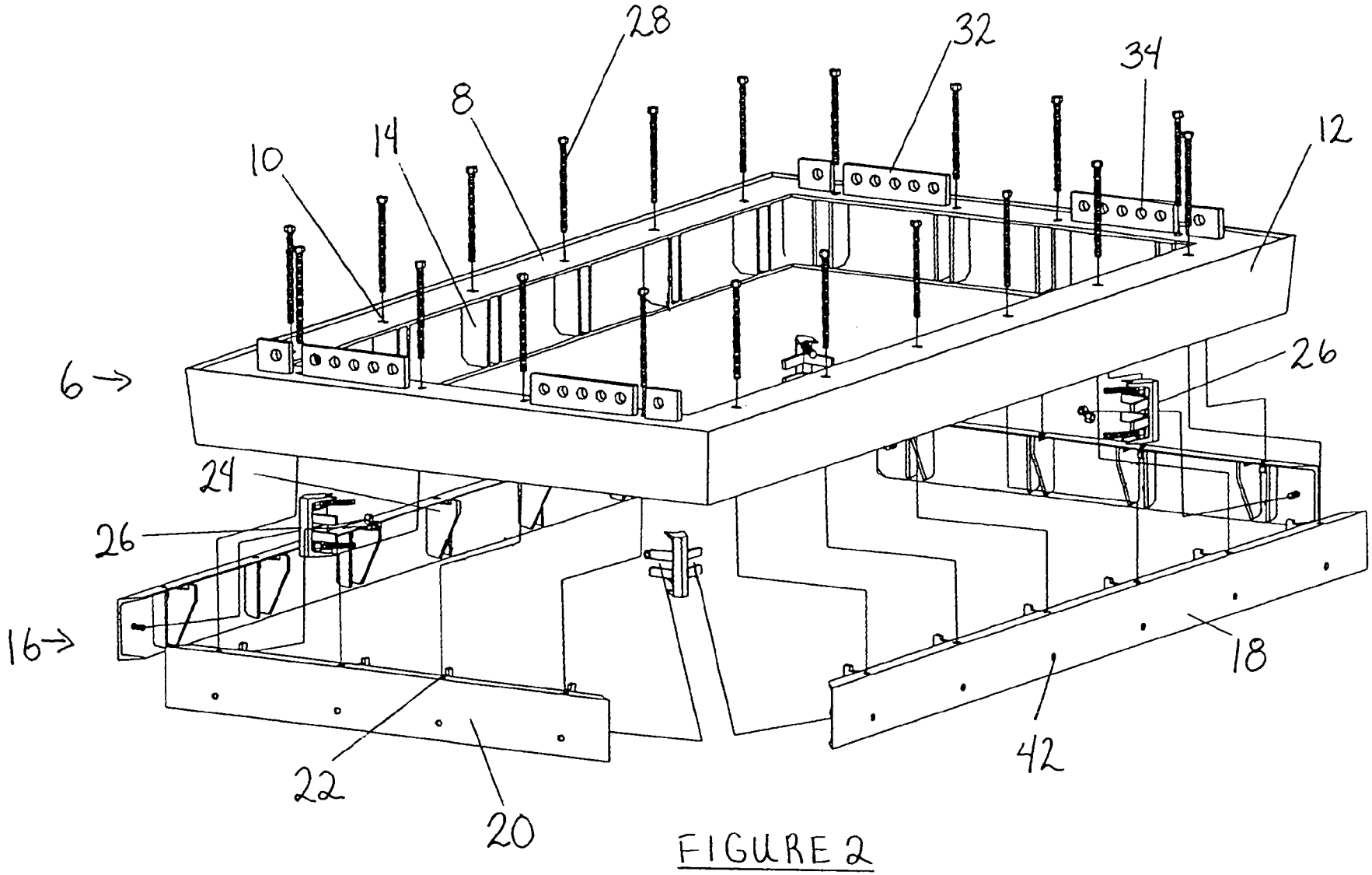
FIG. 2 is an exploded perspective view of the integrated removable handling system illustrated in FIG. 1.
Figure 3:
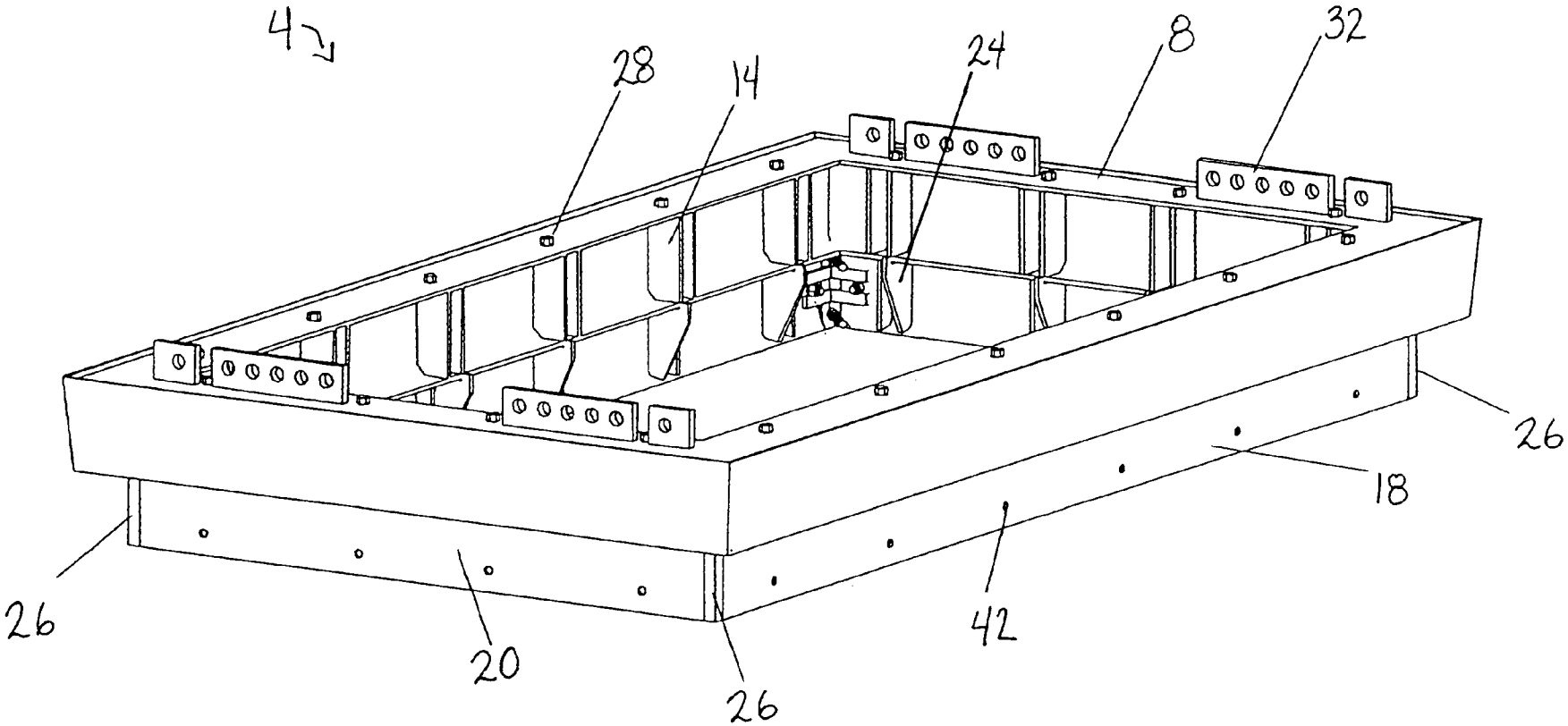
FIG. 3 is a perspective view of the integrated removable handling system illustrated in FIGS. 1 and 2.

The importance of reducing the intervention time of the workers in the presence of electrical cables under tension and of reducing as a whole the time needed to complete the installation of a new structure on the building site is obvious in view of the above description of the existing method for replacing underground structures. As aforesaid, the present invention makes it possible to reduce the time that is presently of about four weeks to complete the work. The invention also makes it possible for the contractor to reduce the intervention time near existing electrical cables under tension.

To achieve this result, the invention makes use of a prefabricated structure made of reinforced concrete. However, depending on the elevation and position of the existing cables, such a structure may present weaknesses which can lead to the formation of cracks or to the breaking of the concrete during its handling.

To deal with this deficiency, the invention thus makes also use of an integrated removable handling system that permits to handle, in a safe way, the prefabricated structure made of reinforced concrete.

Before completing the manufacturing of the prefabricated structure, certain steps have to be carried out. First of all, it is necessary to make a precise list of the parameters of the structure to be replaced at the building site. It is also necessary to locate the existing cables, the position of the new structure as compared to the existing structure, and the position of the access chimneys of the structure to be manufactured. Moreover, it must be checked that no other public utility (gas, drinking water, waste water, etc.) may affect the installation of the new prefabricated structure.

The integrated removable handling system (4) used in the method according to the invention comprises a bottom part (16) hereafter called "bottom module", which is preferably made of steel and preferably in the form of a rectangular frame made of four separable sides that may consist of C-shaped beams (18, 20). The beams (18, 20) comprise holes (42) on their vertical faces which permit insertion of removable fixation means such as bolts, that can be screwed into anchoring plugs previously inserted in the vertical walls of the structure. The C-shaped beams (18, 20) are provided with stiffeners (24) and nuts placed inside their vertical faces. The C-shaped beams (18, 20) are also provided with holes (22) on their top faces to allow passage of fastening means such as lifting rods (28). The bottom module (16) is provided with four removable corners (26) which facilitate unmoulding of the system. Indeed, such removable corners can be withdrawn and then each C-shaped beam can individually be removed in order to facilitate the unmoulding even more.

The integrated removable handling system (4) also comprises a top part (6) hereafter called "top module" (6) forming a rectangular frame made of I-shaped beams (8), with outside inclined sides made of inclined steel plates (12). The I-shaped beams (8) and the inclined steel plates (12) are provided with stiffeners (14) placed inside their vertical sides. These inclined steel plates (12) are also provided with holes (10) on their top faces in order to allow passage of the lifting rods (28). On the top faces of the I-shaped beams (8) and the top faces of the inclined steel plates (12), handles can be provided such as lifting plates (32) extending vertically. These lifting plates (32) are provided with holes (34) to make it possible to attach conventional lifting devices (36, 38, 40) to them.

The first step of the method according to the invention consists of pouring concrete, in factory, to manufacture the prefabricated structure made of reinforced concrete (2) by using the integrated removable handling system (4) as an upper part of the mold. A sheet of Styrofoam® or any similar product with a thickness of a few millimeters, can be placed on the inclined steel plates (12) in order to facilitate later unmoulding. By pouring concrete directly against the integrated removable handling system (4), structural integrity of the prefabricated structure made of reinforced concrete (2) is ensured. Consequently, perfect fitting and rigidity of the structure is achieved, which eliminates the risks of breaking and cracking that may occur in a structure that is importantly weakened by the dimension and the shape of its openings.

While the concrete structure is manufactured, a concrete slab roof can be poured in another mold.

The second step of the method according to the invention consists of unmoulding the prefabricated structure made of reinforced concrete (2). This is advantageously carried out by using the integrated removable handling system (4).

The prefabricated structure made of reinforced concrete (2) may then be stored until the date and hour of delivery are confirmed.

The third step of the method according to the invention consists of installing at the building site the prefabricated structure made of reinforced concrete (2) by using the integrated removable handling system (4). The rigidity of the assembly consisting of the prefabricated structure made of reinforced concrete and the integrated removable handling system, makes it possible for the operator of a crane to achieve precise and safe installation over existing cables.

The fourth step of the method according to the invention is carried out once the prefabricated structure is installed. This step consists of removing the integrated removable handling system (4). The concrete slab of the roof is then installed at the place where was located the integrated removable handling system (4).

The installation may then be completed at the building site with the installation of chimneys, the embankment around the structure and the rebuilding of the sidewalk and/or paving.

It goes without saying that numerous modifications could be made to the preferred embodiment of the invention which has just been described, without departing from the scope of this invention such as defined in the annexed claims. By way of example, in the preferred embodiment described hereinabove, reference has been made to a prefabricated structure of rectangular form, to I-shaped beams, to C-shaped beams, to inclined steel plates, to lifting plates, to lifting rods, to bolts, to Styrofoam®, to stiffeners, to removable corners, to anchoring plugs, to nuts, etc. It must of course be understood that the structures and geometrical configurations of the components described hereinabove are not essential to the invention and should not be taken in a restrictive way to limit the scope of the invention. It would actually be obvious for any person of the art that other components, other types of cooperation between the components as well as other geometrical configurations could be used for the top part, the bottom part, the inclined sides, the stiffeners, the beams, the removable corners, the lifting rods, the lifting plates, etc.

The invention claimed is:

1. A method for manufacturing, transporting and installing on a building site a prefabricated structure made of reinforced concrete by using an integrated handling system that is removable after the installation is completed, said method comprising:

a. manufacturing in a mold the prefabricated structure made of reinforced concrete, by positioning in an upper part of the mold the above-mentioned handling system which comprises external surfaces and fixation means to fix said system in a removable way to the prefabricated structure, and by pouring concrete against the external surfaces of the handling system to form said prefabricated structure directly on it;

b. unmoulding the prefabricated structure from the mold by using the handling system;

c. installing the prefabricated structure at the building site by using again the handling system; and d. removing the handling system from the prefabricated structure by detaching its fixation means.

2. The method according to claim 1, wherein the handling system comprises a top part and a bottom part that are connected to each other by removable fastening means.

3. The method according to claim 2, wherein the fixation means used to fix the handling system to the prefabricated structure are located on the bottom part of said handling system.

4. The method according to claim 2, wherein the top part of the handling system defines an opening and the bottom part of said handling system comprises separable sides and removable corners.

5. The method according to claim 3, wherein the top part of the handling system defines an opening and the bottom part comprises separable sides and removable corners.

6. The method according to claim 2, wherein the top part of the handling system comprises outside faces with inclined sides to facilitate unmoulding of the prefabricated structure.

7. The method according to claim 3, wherein the top part of the handling system comprises outside faces with inclined sides to facilitate unmoulding of the prefabricated structure.

8. The method according to claim 2, wherein the top part of the handling system is provided with handles.

9. The method according to claim 3, wherein the top part of the handling system is provided with handles.

10. The method according to claim 5, wherein the top part of the handling system comprises outside faces with inclined sides to facilitate unmoulding of the prefabricated structure; and wherein the top part of the handling system is provided with handles.

11. A prefabricated structure made of reinforced concrete with a handling system, which is manufactured by the method according to claim 1.

12. A prefabricated structure made of reinforced concrete with a handling system, which is manufactured by the method according to claim 10.

* * * * *